US005513583A

United States Patent [19]

Battista

[11] Patent Number: 5,513,583

[45] Date of Patent: May 7, 1996

[54] COAL WATER SLURRY BURNER ASSEMBLY

[76] Inventor: Joseph J. Battista, 219 S. Thaney St., Ebensburg, Pa. 15931

[21] Appl. No.: 329,412

[22] Filed: Oct. 27, 1994

[51] Int. Cl.[6] ..... F23C 1/10

[52] U.S. Cl. ..... 110/261; 110/104 B; 431/181

[58] Field of Search ..... 110/104 B, 261, 110/262, 347; 239/501, 502, 503; 431/159, 174, 175, 162, 181

[56] References Cited

U.S. PATENT DOCUMENTS

| | | | |
|---|---|---|---|
| 53,208 | 3/1866 | Whelpley et al. . | |
| 137,820 | 4/1873 | Berney . | |
| 449,192 | 3/1891 | Andrews . | |
| 2,128,913 | 9/1938 | Burk | 44/1 |
| 2,560,368 | 7/1951 | Richards et al. | 44/67 |
| 3,168,350 | 2/1965 | Phinney et al. . | |
| 3,341,256 | 9/1967 | Adams | 302/66 |
| 3,393,650 | 7/1968 | Daman et al. | 110/261 |
| 3,456,987 | 7/1969 | Hughes et al. . | |
| 3,589,314 | 6/1971 | Tratz | 110/28 |
| 3,682,114 | 8/1972 | Scheubel . | |
| 4,205,929 | 6/1980 | Schiffman et al. . | |
| 4,304,572 | 12/1981 | Wiese et al. . | |
| 4,402,275 | 9/1983 | Weiner et al. . | |
| 4,432,771 | 2/1984 | Sawyer . | |
| 4,455,148 | 6/1984 | Nagata et al. . | |
| 4,465,495 | 8/1984 | Scheffee . | |
| 4,501,205 | 2/1985 | Funk . | |
| 4,515,602 | 5/1985 | Keller . | |
| 4,519,321 | 5/1985 | Poll et al. | 110/347 |
| 4,529,408 | 7/1988 | Yan . | |
| 4,722,740 | 2/1988 | Donnelly . | |
| 4,749,381 | 6/1988 | Yaghmaie et al. . | |
| 4,762,528 | 8/1988 | Reichl . | |
| 4,776,289 | 10/1988 | Peter-Hoblyn et al. | 110/347 |
| 4,803,932 | 2/1989 | Siwersson et al. . | |
| 4,915,706 | 4/1990 | Daley . | |

FOREIGN PATENT DOCUMENTS

| | | | |
|---|---|---|---|
| 2085575 | 4/1982 | United Kingdom | 110/262 |

*Primary Examiner*—Henry A. Bennet
*Assistant Examiner*—Susanne C. Tinker
*Attorney, Agent, or Firm*—Abdallah & Muckelroy

[57] ABSTRACT

In a conventional air burner for combustion of pulverized coal having a back and a front, and a coal feeding tube for the pulverized coal extending from the back to the front, an oil igniter connected to the front of the burner, an oil feeding tube connected to the oil igniter, the oil igniter when fired ignites the oil projecting a starter flame at the front of the burner, the starter flame ignites a continuous supply of the pulverized coal conveyed to the starter flame at the front of the burner to create a pulverized coal fueled flame, an improvement wherein a metal tube for conveying a suspension of fine-grained coal in a liquid or aqueous slurry is inserted through the burner and extends from the back to the front and wherein the metal tube is attached to a nozzle oriented and adapted to spray the aqueous slurry into the pulverized coal fueled flame.

8 Claims, 4 Drawing Sheets

COAL WATER SLURRY BURNER ASSEMBLY

BACKGROUND OF THE INVENTION

1. Field of the Invention

The present invention relates generally to a mechanical burner assembly particularly intended for the continuous simultaneous combustion of two different hydrocarbon-based fuels which after being independently introduced to a flame, but fired together sustain combustion. In particular, this invention relates to a burner or other apparatus for continuously co-firing a suspension of fine-grained coal particles in a non-combustible liquid such as water with firing of pulverized coal.

2. Description of the Prior Art

In the coal burning industry coal particles are often referred to as fines and the size of the particles is defined by their capacity to pass through a particular mesh filter. Low cost coal fines or coal particles can be derived from particle coal streams and operating coal processing plants or coal ponds comprising a mixture of coal particles and water. The prior art has determined that the economics for the use of coal fines or particles favor the use of less than 100 mesh coal particles or coal fines which are classified or removed from a coarse coal stream of greater than 100 mesh fines or particles.

When less than 100 mesh coal fines or particles are processed into an aqueous slurry it is unnecessary to use cost-adding stabilizers, dispersoids or to utilize additional energy to produce the less than 100 mesh coal particles or ultrafine coal by grinding of larger pulverized coal pieces.

It is important for environmental reasons that wet fine coal slurry accumulation be carefully managed and consumed if possible. Accumulation can be prevented by initially separating fines from coarse coal during wet processing at mine sites, and transporting the fines in slurry pipelines to the point of utilization separately from the conventionally transported bulk coarse coal. Dust losses to the environment could be prevented by commercial economically viable burning of the slurry if such a burner and process were available. The capacity to economically burn a slurry will prevent the fines in the slurry from locating near the surface and drying and dusting off into the atmosphere. Burning of the slurry in the novel burner reduces the cost of energy from coal pulverization at the power plant. The energy cost is greatly reduced because of the use of the previously removed fines as fuel.

To eliminate environmentally undesirable dust losses, problem causing fines are initially removed from coal and later systematically re-mixed as a slurry. Some of the fines removal takes place at the mine site during wet processing.

It has been a persistent quest in the prior art to discover a way to burn a slurry recombined with the conventionally transported coarser pulverized coal. Heretofore, the effort was either to make the slurry capable of sustaining combustion alone or to mix the slurry with large pulverized pieces of coal before firing. The novel modified burner assembly avoids recombination and instead allows firing in the pulverized coal flame to take place at the point of combustion. The coal-water slurry is co-fired to fuel steam generators.

Heretofore, a burner assembly for the co-firing of coal-water slurries with pulverized coal on a commercial basis had not been achieved. From a utility company standpoint it is desirable to co-fire a coal water slurry fuel at, for example, the rate the slurry is produced from coal cleaning and by-product coal-water slurry production facility or to have a continuous supply from a reservoir. To be economically viable, it is necessary that a furnace for burning coal-water slurry be able to burn a slurry containing 50% solids for coal particles by weight or less.

In 1891, this technology started when Andrews was granted U.S. Pat. No. 449,102 which generally disclosed the mixing of coal dust with water to form a coal water slurry to be transported through pipes or the like to reservoirs, ponds or tanks. In 1936, Burke was issued U.S. Pat. No. 2,128,913 for an improvement in the coal water slurry process for transporting coal by changing its state to pumpable fluid by grinding the coal and mixing the disintegrated coal with water and a small amount of water soluble soap and then coagulating the suspending agent, for example, adding a mixture of lime to recover the coal.

U.S. Pat. No. 2,791,471 entitled "Transportation of Coal by Pipeline" described and claimed a coal water slurry comprising coal particles mixed with water having a spectrum of sizes with a nominal top size in the range of 6 to 28 mesh Tyler standard screen series and having less than 25% by weight of particles having a size greater than 14 mesh. The patent further indicated that the coal particles having the aforementioned size distribution and nominal top size were mixed with water to prepare a slurry comprising 35% to 55% by weight of the coal particles and the remainder water. The patent further disclosed that the slurry was pumped through a long distance pipe line at a linear velocity of between 4 to 7 feet per second and recovered at the delivery end of the pipeline.

U.S. Pat. No. 3,168,350 issued to Phinney in 1965 recognized that an important limitation of a slurry prepared according to the aforementioned recipe requires the expenditures of a significant amount of energy to convey the slurry through a long distance pipeline. Phinney also recognized that the slurry according to the recipe is unstable and that under static conditions the coal particles quickly settle out of the slurry as a highly immobile mass. Phinney was able to considerably reduce the energy necessary to convey the slurry described by blending in a prescribed manner two quantities of coal each having a different spectrum of particle sizes and mixing the blended coal particles with water. The synergistic discovery was that the energy requirements of the slurry prepared from the blended coal particles was less than the energy requirements to transfer slurries prepared from either of the two quantities having a different spectrum of sizes alone. In other words, what was discovered was that by blending two slurries each having a different spectrum of coal particles both with high transportation energy requirements a slurry was obtained which had a transportation energy requirement less than either of the two slurries originally employed in the blend. What Phinney discovered was to blend relatively coarse coal particles having a spectrum of sizes and a nominal top size of 4 mesh of the spectrum with relatively fine coal particles having a substantial quantity of particles smaller than 325 mesh.

Adams in U.S. Pat. No. 3,341,256 issued in 1967 and entitled "Process for Conveying Mineral Solids Through Conduits" describes the procedure at the time for pipeline transport of coal as first pulverizing the coals to a size range in which practically all the coal is less than ⅛ inch with approximately 30% passing through 200 mesh screen and then incorporating water to create a pumpable slurry. Adams pointed out that techniques had been devised to burn the slurry directly but the result was not commercially viable because the burning resulted in too great of a reduction of thermal efficiency. Adams developed a thixotropic mixture to defeat settling velocity of large coal particles from settliing rapidly through the low viscosity water of the slurry. This thixotropic means comprised a fluid or gel prepared from a mixture of water, leonardite, sodium hydroxide and calcium oxide. This thixotropic fluid in various proportions was discovered to be an excellent suspension medium for pipeline transportation of solid materials such as coal. Unfortunately, after transport, the solid materials, mainly the coal, had to be separated from the gel.

U.S. Pat. No. 3,589,314 issued in 1971 to Tretz for a method and device for pressure spraying and burning a coal dust-water mixture. Tretz pointed out that in 1971 experiments were being carried out internationally to develop methods for directly burning mixtures of coal dust and water in power plants. However, the then state of the art mixtures contained about 60% coal dust and 40% water by weight which causes continuous processing problems.

Tretz discloses the direct combustion of the then state of the art, heavily loaded, coal-water slurry after direct transport through a pipeline. The mixture, capable of sustaining combustion, was burned after spraying into a furnace or burner via a high pressure rotary sprayer or spray nozzle. The Tretz method burns a coal-water slurry where prior to discharging the slurry from a nozzle at a pressure of several atmospheres the slurry is heated to a temperature just below the water-vaporizing temperature upstream of the nozzle to pressure-relieve and vaporize the water in the slurry into steam directly after passing through the nozzle. The coal-water slurry is accumulated in a funnel shaped supply vessel from which it is supplied to the burners of a power plant upon demand. The supply vessel is adapted to stir or agitate its contents to prevent settling of the coal dust from the slurry. The coal-water slurry is preheated in a heat exchanger with superheated steam.

In another embodiment of the invention, the coal-water slurry is heated in a nozzle by a suitable electric heating device surrounding the nozzle. A temperature sensing device located down stream of the electric heater controls a regulated voltage source which provides energy to the heater adapted to the nozzle.

The Tretz method for burning a coal water slurry is limited to a highly loaded 60% to 40% prior art coal dust to water mixture by weight.

In August 1978 U.S. Pat. No. 4,094,035 issued to Cole et al contained a disclosure that a coal water slurry with more than 50 wt. % of coal was unpumpable. Liquid fuels, coal water slurries included, according to the prior art must be vaporized before they can be burned.

Large capacity industrial burners use two sequential steps, atomization plus vaporization, to get liquid carbonation fuel into a combustible form. Atomization is the process of breaking a liquid into a multitude of tiny droplets. By first atomizing the liquid carbonation fuel or coal-water slurry and thus exposing the large surface area of millions of tiny droplets to air and then to heat, atomizing burners are able to vaporize liquid carbon based fuel at very high rates. See, *North American Combustion Handbook,* Second Edition, North American Manufacturing Company, Cleveland, Ohio, 1978, pages 251 and 418.

Generally, the prior art discloses that the viscosity required for a coal-water slurry for effective atomization is substantially lower than the viscosity required to effectively pump the slurry. In summary, the prior art teaches that carbon based slurries containing more than about 50 wt. % coal cannot be effectively atomized and burned. Firstly, because they cannot be pumped to the atomizer and because of a solids contents of greater than 50 wt. % they are unpumpable. Secondly, even when the slurries have low enough viscosity to be pumpable they often have too high a viscosity to be effectively atomized and burned.

Funk discloses a process for burning a carbonaceous slurry having at least 55 volume % carbon material whereby the slurry is atomized and subsequently combusted. A burner which utilizes a coal-water slurry is described in a publication by T. M. Sommer and J. Funk entitled *Development of a High-Solid Coal-Water Mixture for Application as a Boiler Fuel* which was contributed by the Fuel Division of the American Society of Mechanical Engineers for presentation at the joint ASME/IEEE Power Generation Conference, Oct. 4–8, 1981, St. Louis, Mo. (pgs. 1–4); the disclosure of this publication is hereby incorporated by reference herein as prior art. The prior art coal-water slurry generally described by Funk is comprised of a fine or fine slurried product of a concentration of preferably more than about 50 wt. % of solids. A fine consist is combined with a coarse consist of coal particles having a mean particle size which exceeds 40 microns. The coarse and fine fractions are then combined with each other, a carrier liquid and a disbursing agent to produce a grinding mixture comprised of from about 60 to about 82 vol. percent of coal, from about 18 to about 40 volume percent of carrier liquid or water, and from about 0.01 to about 4.0 wt. % of a dispersing agent.

In 1981, Wiese was issued U.S. Pat. No. 4,304,572 for a method of producing a pumpable slurry with a high solids content. Wiese points out that coal as mined contains varying amounts of water which in some instance may range up to 40% by weight or even higher in the case of low grade coal. Wiese suggests that even this 40% water content is an undesirable constituent of the fuel. It is pointed out that if solid fuel is to be transported by pipeline in the form of a slurry, water trapped in the pores of the solid fuel which takes no part in the formation of the slurry are also transported. Thus, the slurry containing 50% by weight water and 50% by weight solid fuel would contain considerably less than that amount of fuel when the fuel therein is measured on a dry basis.

The amount of water necessary to form a pumpable slurry depends, according to Wiese, on the surface characteristics of the coal. In the case of a slurry which is to be fed to a gas generator, Wiese suggests it is necessary that the coal be ground to such an extent that a major portion thereof will pass through a 200 mesh sieve so that the particles are small enough to be substantially completely converted to oxides of carbon during their short residence time within the gasification zone in a gas fire furnace. Wiese teaches that for the slurry to be pumpable it must be made up of solid fuel particles most of which will pass through a 200 mesh sieve and that the coal water slurry contain from about 55 to 60 weight percent water. Wiese further points out that a slurry containing this amount of water renders the operation of the gas fired furnace unsatisfactory. The excess water moderates the temperature of the reaction zone to such an extent that it is thermally inefficient.

In 1984, Sawyer, Jr. was granted U.S. Pat. No. 4,432,771 for a combustible coal water slurry mixture and method for preparing same. The composition disclosed is a coal-water slurry containing 65 to 70 wt. % coal.

It was previously believed generally necessary to incorporate a maximum amount of coal in the slurry. The perceived solution to the problem of burning slurry in the prior art was to maximize the coal and maintain rheological characteristics that assure good stability and spray ability in the burner nozzle for combustion of the slurry by itself. The maximum solids in a coal-water slurry is suggested in the prior art to be about 70 to 75% and a satisfactory slurry is suggested to only be attained with relatively round particles, a high percentage of fine particles and a dispersing/wetting agent. For any medium to long range stability, a gelling agent that imparts gel properties to the continuous water phase according to the prior art, was required.

Forster in U.S. Pat. No. 4,444,126 issued in 1984 discloses an apparatus for combustion of a suspension of coal particles in water. Combustion air preheated to 550 degrees C. is forced into a coal-water slurry preheated to 100 degrees C. in a portion of a burner upstream of the burner flame. Air passes into the preheated suspension through a porous wall which is preheated and it separates the end portion of the air duct from the suspension duct. Preheating is done by recuperators, through which the combustion product gases from the furnace flow before being discharged at a temperature low enough for evaporating the condensed water.

Four months later, Scheffee in U.S. Pat. No. 4,465,495 disclosed a process wherein a high fuel value coal-water slurry is directly injected into a furnace as a combustible fuel for the express purpose of supplanting large quantities of increasingly expensive fuel oil used by utilities, factories, ships and other commercial enterprises. Scheffee teaches the slurry should be loaded with finely divided coal in amounts as high as 50 wt. % to 70 wt. % of the slurry. Scheffee is generally directed toward burning of highly loaded coal-water slurries which are fluidic dispersions characterized as thixotropic or Bingham fluids having a yield point.

In 1985, U.S. Pat. No. 4,501,205 was issued to Funk for a process for burning a coal- water slurry containing at least 60% by volume carbon solids. Funk suggests again that coal water slurries prepared with a carrier liquid are unstable at solids contents exceeding about 50 wt. %. Funk indicates the use of more than about 50 wt. % of coal in a coal-oil mixture has an adverse effect upon the pumpability of the mixture.

Keller, Jr. et al in U.S. Pat. No. 4,515,602 issued in 1985 describe another prior art composition containing coal and water which can be used as a fuel. Keller correctly points out that it is part of the prior art that dwindling supplies of petroleum and natural gas and concerns about the regular availability of those products from foreign sources have led to increased interest by utilities and other consumers in the use of coal water slurries as an alternative fuel. Coal-water slurries reported in the patent and open literature for the most part have a particle size distribution of 60–80 plus or minus 200 mesh (74 microns)×0 and ash contents of 3 plus to over 10 wt. %. Such mixtures are described in the patents previously discussed herein and in the following papers, all presented at the Fourth International Symposium on Coal Slurry Composition, Orlando, Fla., May 10–12, 1982: K. Aoki et. al, *Pre-treatment of Coal for Coal Water Slurries*, Sumitomo Heavy Industries, Ltd.; R. Ebri et. al, *Coal-Oil Mixture and Coal-Water Mixture Fuels for Steam Generators*, Combustion Engineering, Inc. G. Germane et. al, *Coal-Water Mixture Combustion Studies in a Laboratory Cylindrical Combustor*, Combustion Laboratory, Brigham Young University , Ghassemzadeh et. al, *Rheology and Combustion Characteristics of Coal-Water Mixtures*, Babcock and Wilcox Company; and R. Scheffee et. al for *The Development of an Evaluation of Coal-water Mixture Technology*, Atlantic Research Corporation. The Keller coal-water slurry disclosed has a particle size distribution of less than or equal to 30 microns×0 and an ash content that can range down to 1.5 to less than 0.3 wt. %. In one example, Keller points out that the resulting coal water slurry has a solid concentration of 50 wt. % and an absolute viscosity of 3300 centipoises at a shear rate of $5^{-1}$ seconds.

Tratz used a nozzle to spray a preheated slurry at several atmospheres into a combustion chamber and was predisposed to the notion that the nozzle and line would clog up unless the slurry was preheated.

Forster developed and patented a burner directly solely to the combustion of a preheated aqueous coal slurry.

As late as 1989, Siwersson was still approaching the problem of combusting a coal-water slurry as one wherein the slurry had to sustain its own combustion in the same manner as oil. Siwersson of Sweden patented a burner for an aqueous fine-grain coal solution which directed the slurry to a baffle opening to a rotating cup so that the aqueous slurry flowed outward from the baffle by centrifugal force.

A prior art rotary burner, as well as other known rotary burners, for oil has proved to be practically unusable, since, on the one hand, the fine-grained suspension showed a tendency to plug the flow channels and, on the other, the suspended particles had a tendency to stick to the inner side of the rotating burner cup and be burnt thereto because of too high of a solids content and the persistent effort to make the slurry capable of self sustaining combustion. A known oil burner type operates according to the so-called toroidal principle where the oil mist sprayed out from the nozzle is surrounded by a conically diverging air stream which, by a kind of ejector effect, produces a recirculation of the combustion gases inwards towards the oil burner nozzle. Attempts to use this known oil burner type for the combustion of the above mentioned special fuel in the form of a suspension of fine-grained coal particles in a liquid have also failed mainly because of the perceived necessity for self-sustaining combustion.

German Patent Specification No. 594,722 discloses a vertical oil burner in which the fuel is supplied by self-priming to the mouth of a pipe which extends into a rotary cup and terminates above the bottom thereof, such that the fuel is expelled towards the edge of the cup so as to be distributed by this edge into an air stream ascending around the rotary cup. Oil drops that are not entrained by the air stream are caught by a conical screen and flow down into an oil collector against the action of the ascending air stream which is produced by means of an annular nozzle disposed beneath the rotary cup. This prior-art oil burner rather operates in accordance with the rotary burner principle but not according to the above-mentioned toroidal principle since the gas velocity at the edge of the rotary cup is so low that it permits oil drops both to hit the surrounding screen and to descend along this screen. This known burner is not usable for a slurry in the form of a suspension of fine-grained coal particles in a liquid having less than 70 weight % solids either.

According to Siwersson et. al, by combining the per se known rotary burner principle with the per se known toroidal burner principle, it is possible to provide a burner which readily permits combustion of a slurry provided the slurry is structured for self-sustaining combustion, i.e., having about 70 weight % coal fines content by weight and about 30 weight % water.

Over the years, different kinds of such fuels have been proposed, but for these fuels to be economically advantageous, until the present invention, it was essential that the amount of liquid in the suspension be kept low. However, the lower the liquid content is, the greater are the difficulties of handling the slurry as a fuel. A type of such a coal suspension developed to solve difficulties associated with high solids content slurries is described in U.S. patent application. Ser. No. 908,497. The fuel disclosed therein consists of a very finely divided coal dust suspended in a liquid which is usually water but which may also be combustible in itself. This liquid fuel contains a suspending agent for maintaining the coal powder particles in suspension. This fuel consists of about 70% by weight of coal, about 30% by weight of water, and a small amount of suspending or dispersing agent, for instance 0.3% by weight, calculated on the whole of the fuel. The viscosity of the fuel may amount to 2500 cP Brookfield, and the particle size of the coal typically is about 50 μm. The thermal value of the fuel typically is 21–25 MJ/kg (5.8–6.9 kWh/kg). A certain amount of fine-grained lime may also have been added to the fuel in order to neutralize the sulphur content of the coal.

This fluid suspended fuel was developed as a substitute for oil and gas but it gives rise to difficulties when burnt because of the tendency of the fuel to choke channels and the like. Attempts to use this combustible suspension in conventional oil and gas burners, have been met with serious problems. Plugging of nozzle orifices has been a primary problem.

Thus, heretofore, engineers made the slurry independently combustible or capable of self-sustaining combustion. Subsequently, unsuccessful attempts were made to use the combustible suspension in conventional oil and gas burners.

As evinced by the foregoing prior art references, engineers and scientists have been attempting to solve the problem of how to consume aqueous solutions of fine-grained coal by defining those physical attributes of a composition which allow easy transport and which sustain independent combustion rather than creating a burner which accommodates a slurry as it is commonly available or normally and customarily produced.

Hence, according to the present invention, it has quite surprisingly been discovered that by combining direct input of a slurry containing a high water content, as high 62 weight % water, using a conical spray nozzle for delivery via a direct pressurized tube extending through a burner customarily adapted to fire pulverized coal, as long as the pulverized coal is initially fired, the subsequently introduced slurry co-fires in the burner with the pulverized coal without any difficulty whatsoever.

The novel burner assembly has been demonstrated in a commercial boiler using six burners, three of which were structurally modified according to the principles and concepts of the invention as set forth herein.

Remarkably, a long-felt need in the industry has been met by a relatively simply solution. A novel burner arrangement has been discovered, tested, and implemented which enables economically profitable, commercial burning of slurries containing from 38 to 70 weight percent coal fines and reciprocally from 62 to 30 weight percent water, respectively, by co-firing the slurry with pulverized coal.

SUMMARY OF THE INVENTION

The invention is a mechanical assembly of parts made either of metal or ceramic or a combination thereof wherein a standard central tube and igniter assembly for providing either an oil fed flame or a gas fed flame is attached to an elongated tubular structure adapted to continuously deliver pulverized coal to the gas-fed or oil-fed relatively cooler flame whereby the pulverized coal once ignited by the relatively cooler flame and burning of the pulverized coal has commenced, continues to burn producing a relatively hotter flame via self-sustaining combustion. The burner is adapted with a nozzle aimed at the center of the hotter flame, a substantially linear tube extends from the rear of the burner and is connected to the nozzle to deliver an aqueous solution containing coal fines. The nozzle is aimed such that its imaginary longitudinal axis is approximately 4 degrees with respect to the imaginary longitudinal centerline axis of the burner. The nozzle is adapted with a round aperture which provides a solid 30 degree conical spray concentric with an imaginary longitudinal axis extending through the aperture of the nozzle and which conical spray intersects an imaginary centerline of the hotter flame exiting from the burner. The conical spray is aimed to also intersect the center of the hotter flame with its imaginary longitudinal centerline.

The modified burner assembly is a novel improvement of a conventional pulverized coal burner adapted to allow a novel process for burning a coal-water slurry comprising clean coal fines at about 50 weight % and water at about 50 weight % by co-firing the coal-water slurry in a continuous stream of a spray with a separate stream of pulverized coal wherein 80% of the total thermal output of the furnace is provided from the pulverized coal and approximately 20% of the heat output is provided from the coal-water slurry. The furnace is initially ignited or fired with a fuel source of oil or natural gas. A coal-water slurry with fines, preferably minus 100 or smaller is subsequently gradually introduced into the furnace after the pulverized coal is ignited in a sustained burn.

The novel burner assembly is important to electric energy production because by allowing the co-burning of pulverized coal simultaneously and continuously with a coal-water slurry the burner permits the elimination of costly fine coal dewatering and drying at both the mine site and the electric utility site where the pulverized coal is burned to produce electricity. Burning of the pulverized coal and slurry together in the novel process reduces the cost of energy from further coal pulverization at the power plant. The energy cost is further reduced because of the use of the previously removed fines washed from the pulverized coal into lakes of slurry as fuel.

The novel burner is of significant importance to the environment because as artificial ponds and lakes of unusable coal-water slurries are created or the fine content of these ponds and lakes increase, they form a potential or actual source for polluting adjacent land and water sources. The novel burner assembly provides for the consumption of the slurry lakes and ponds as an energy producing fuel source.

OBJECTS OF THE INVENTION

It is a primary object of the novel invention to provide a modified conventional burner assembly which customarily burns only pulverized coal in a boiler to produce steam with the additional capability of being able to simultaneously burn a coal-water slurry whereby the slurry is consumed and provides a part of the thermal energy output from the burner.

It is a secondary object of the invention to provide an economical structural modification to an existing pulverized coal burner whereby the modified structure is capable of co-firing the pulverized coal and a coal-water slurry incapable of sustaining combustion by itself.

It is yet another object of the invention to provide an improved pulverized coal burner capable of optionally firing pulverized coal or co-firing pulverized coal and a coal-water slurry.

It is still a further object of the invention to provide an improved pulverized coal burner which uses a smaller oil burner as an igniter or a smaller gas burner as an igniter to fire continuously fed pulverized coal and which has an integral component for injecting an aqueous solution containing any amount of coal fines (up to about 70 weight percent coal fines) for co-firing with the pulverized coal.

The construction of the novel invention and its method of operation together with additional objects and advantages thereof will be more fully understood from the following description of a specific embodiment when read in connection with the accompanying drawings, to wit:

DESCRIPTION OF THE PREFERRED EMBODIMENT OF THE INVENTION

Figure 1:
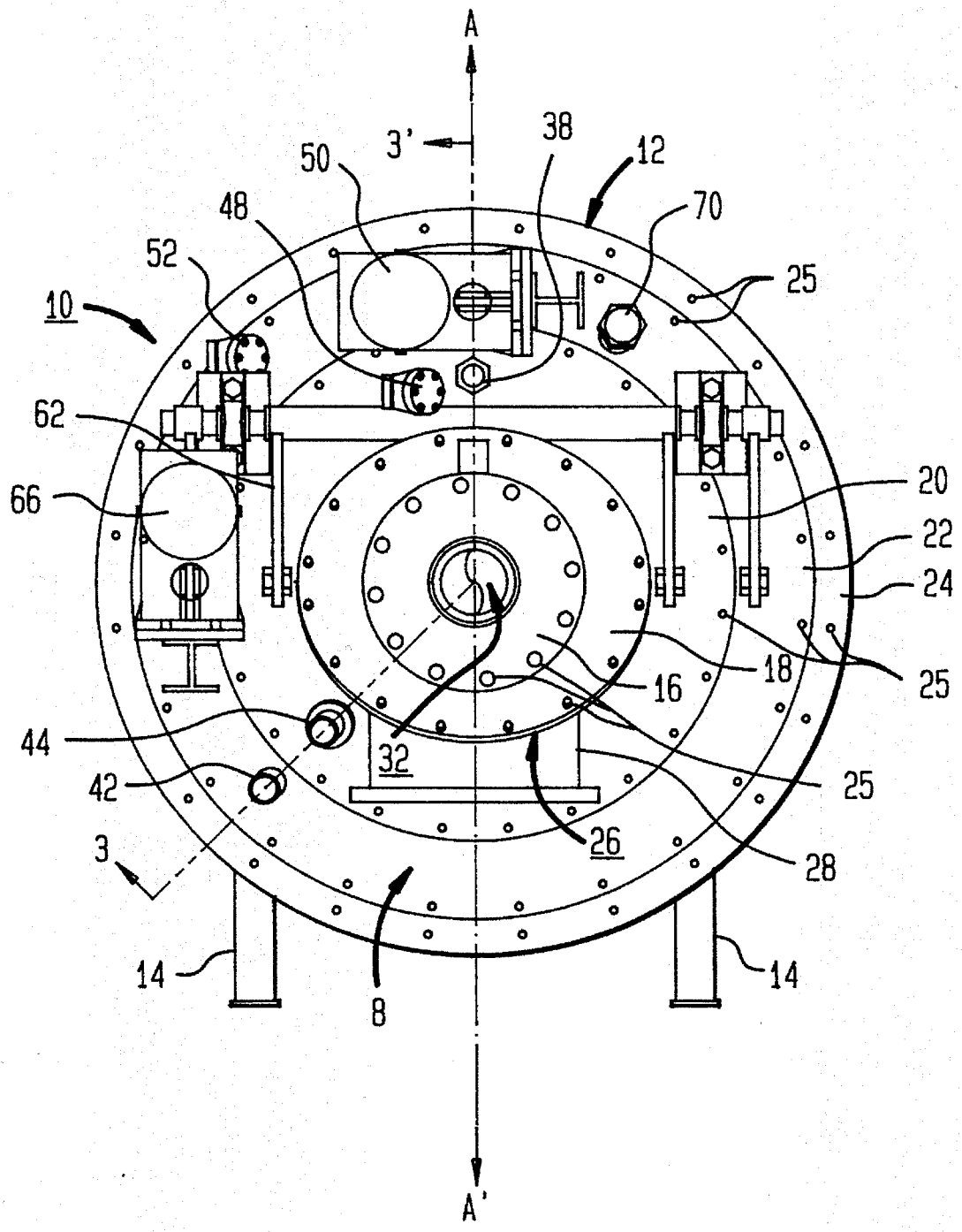
FIG. 1 is a view of the rear of the novel burner assembly for co-firing pulverized coal and an aqueous solution of fine-grained coal showing the entry position of the integral coal-water slurry tube entrance into the burner.

FIG. 1 shows the rear 8 of a burner 10 made according to functional requirements of the invention. A mounting ring flange 12, approximately 5 feet in diameter, is shown welded in place around the burner 10. The burner is assembled to the mounting ring flange 12 with a plurality of support rails 14 and bolts (not shown). The rear 8 is covered and sealed by a plurality of circular concentric heavy metal plates 16, 18, 20, 22, and 24 each bolted down by a plurality of like bolts 25. The plate 18 is obliquely secured to an elbow 26 in a pipe 28 for intake of pulverized coal (not shown).

Concentrically located in the rear 8 and extending along a central longitudinal axis 30 of the burner 10 (see FIG. 3) is an oil igniter or oil lighter 32. The oil lighter 32 is a sealed tube 34, cylindrical in shape, for example, which extends through the center of the burner 10. The tube 34 carries pressurized oil to the front 40 (see FIG. 2 and FIG. 3) where the oil is ignited and burns to provide a first cooler flame at the front 40 of the burner 10.

There is shown in FIG. 1 the rear of a flame scanner sight tube 42 which extends parallel to the axis 30 to the front 40 to allow observation of any flame extending from the front 40 of the burner 10. The rear 8 is shown divided by an imaginary vertical plane A—A'. Above and to the right of the sight tube 42 is located the coal-water slurry input tube 44. The input tube 44 is connected to a pressurized source of coal, water slurry (not shown) at approximately 140 psi, for example. The input tube 44 extends towards the axis 30 at approximately 4 degrees. The input tube 44 and the sight tube 42 are located in a plane 3—3' rotated 45 degrees from the plane A—A' about the axis 30. The rear of the input tube 44 located at the rear 8 of the burner 10 has its center located about 15 inches from the center of the oil lighter 32. The burner 10 is approximately 10 feet long, for example, and about 5 feet in diameter.

Figure 2:
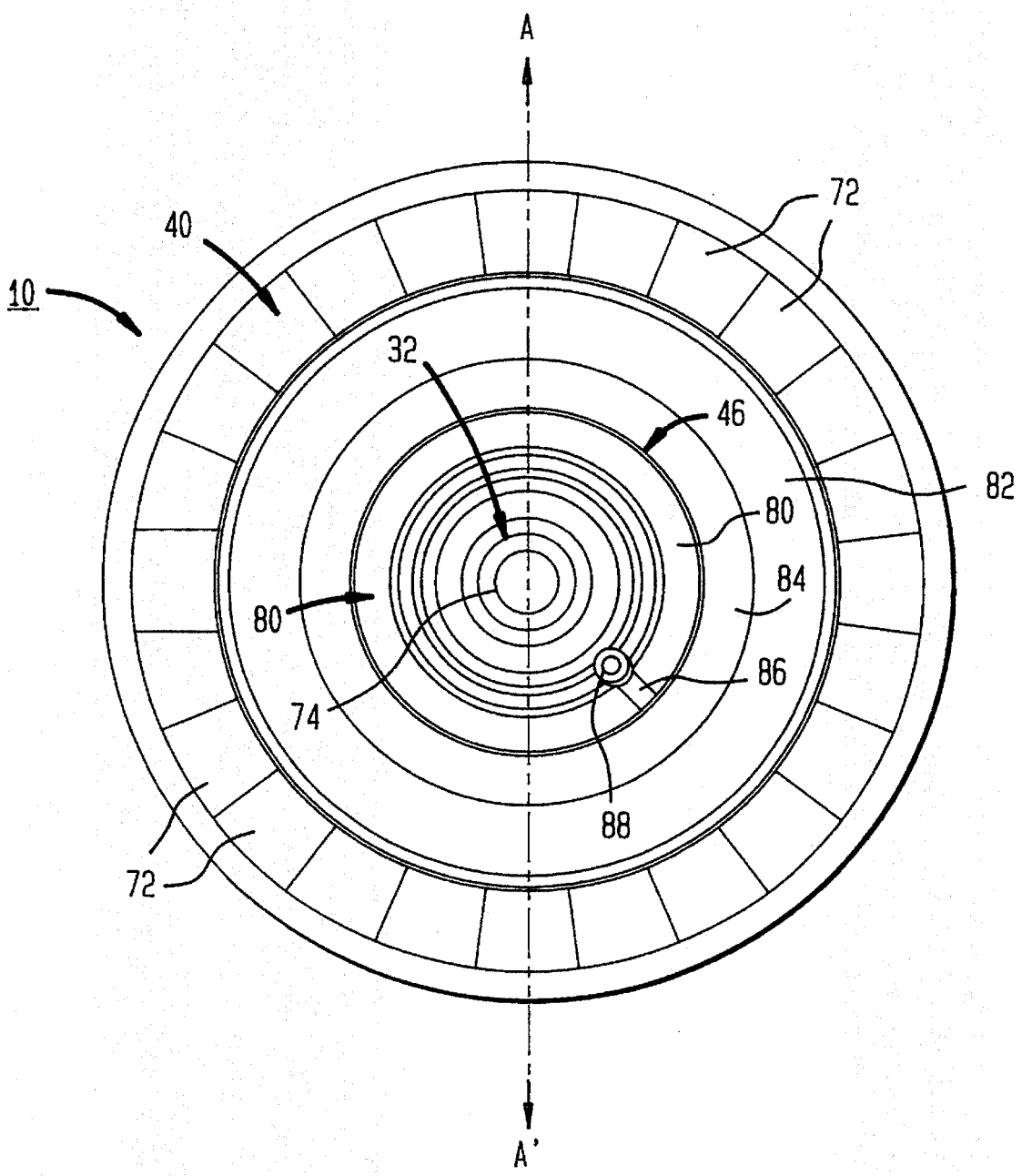
FIG. 2 is a view of the front of the novel burner assembly for co-firing pulverized coal and an aqueous solution of fine-grained coal showing the position of the nozzle attached to the end of the integral coal-water slurry tube at the front exhaust for the flame from the burner.

In FIG. 2, there is shown a nozzle 46 for spraying the pulverized coal at the front 40 of the burner 10. The nozzle 46 is about 15 inches in diameter and surrounds the oil lighter 32, manufactured by Forney™, for example, which is about 7 inches in diameter, for example.

Referring again to FIG. 1, there is shown a coal nozzle thermocouple 48, a burner air control actuator 50, and a burner throat tube thermocouple 52. The actuator 50 controls the flow of air lengthwise through the burner 10 in combination with a manual actuator 54 for a secondary air swirler 56 located inside the burner 10 (as shown in FIG. 2). There is also shown another manual actuator 58 for controlling a secondary damper 60 inside. Another manual actuator 62 controls a secondary air swirler 56 located inside. There is a tertiary air swirler actuator 64 for controlling a tertiary air swirler 66 inside and an observation window 70.

Figure 3:
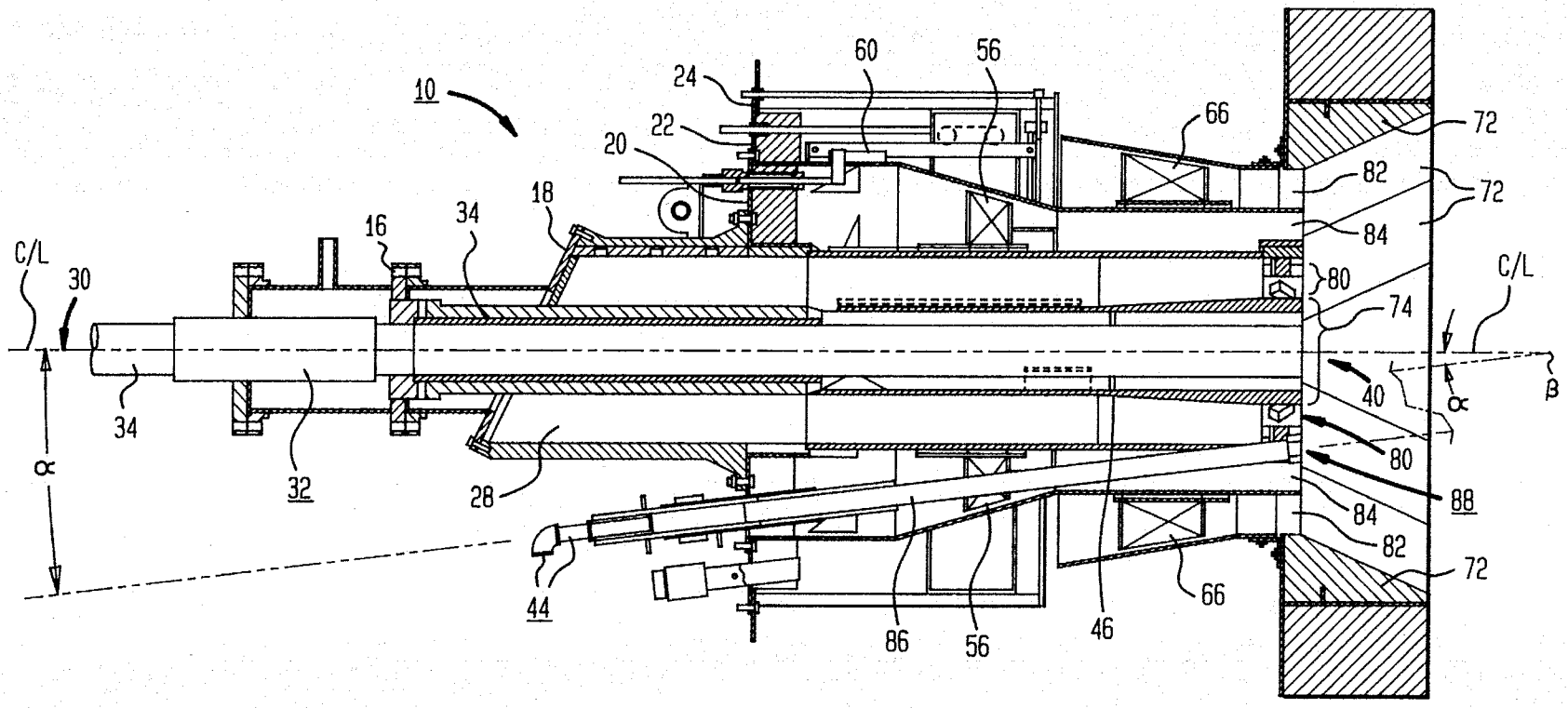
FIG. 3 is a cross-section of the novel burner assembly for co-firing pulverized coal and an aqueous solution containing coal fines taken at the sectional plane 3—3'.

In FIG. 3, there is shown the throat of the burner 10 covered with ceramic, kiln-fired, refractory tiles 72 surrounded by the mounting ring flange 12. Also shown is a nozzle 74 connected to the oil lighter 32, a pulverized coal nozzle assembly 80, a tertiary air exit 82, and a secondary air exit 84. The pulverized coal which is ejected via the nozzle assembly 80 is automatically mixed with air.

Figure 4:
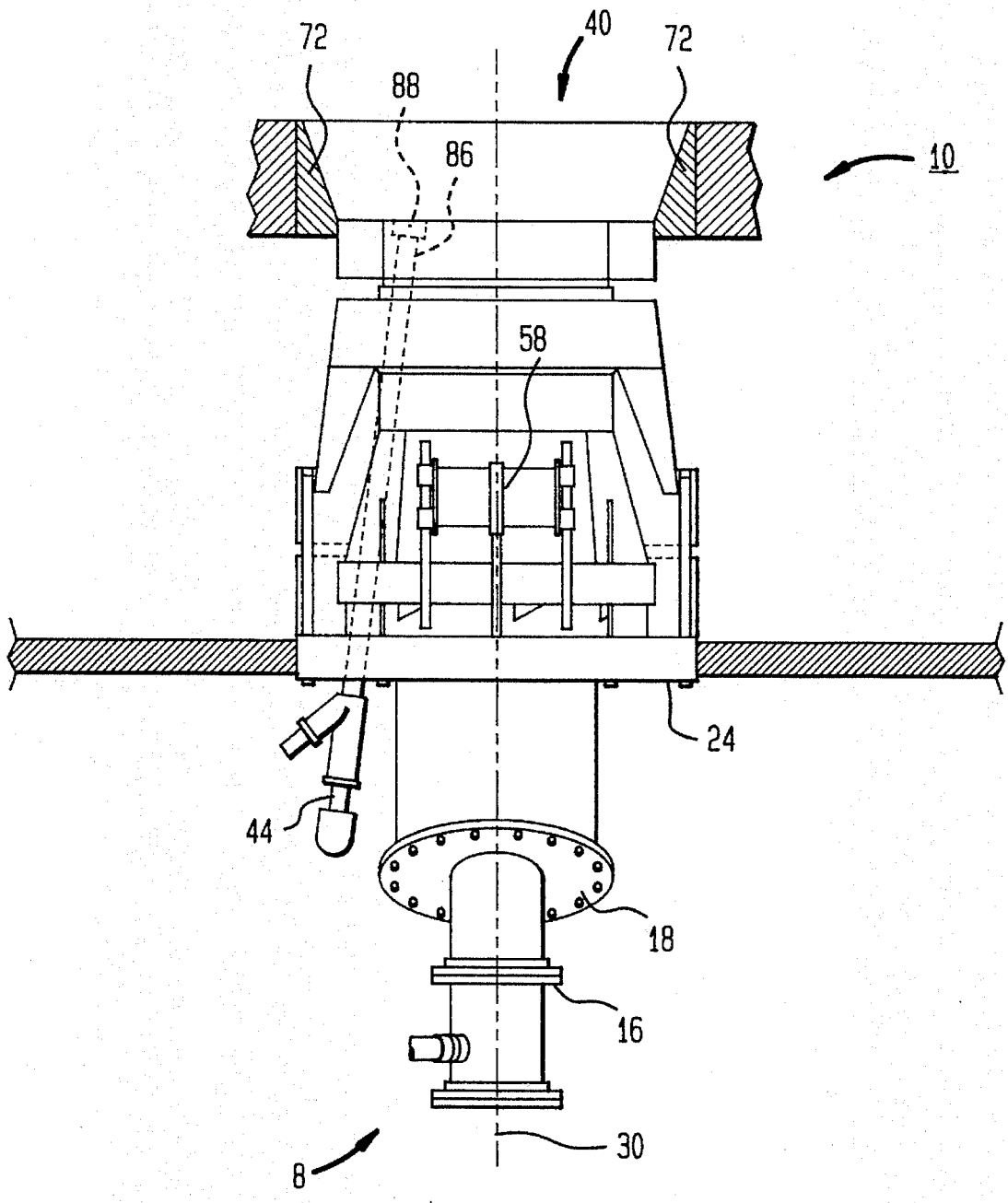
FIG. 4 is a perspective view of the top of the novel burner assembly shown in FIGS. 1 through 3.

Referring again to FIGS. 2 and 4, the coal-water slurry input 44 is connected to a sealed delivery tube 86 which linearly extends to a coal-water slurry nozzle 86, either a 4.25 mm or a 8.5 mm Veerjet™ commercially available from Energy Environment Research Corporation of Irvine, Calif., for example, located in the lower left quadrant of the secondary air exit 84.

The nozzle 88 is conventionally adapted to spray an aqueous solution in a solid conical pattern concentric with the longitudinal axis of the tube 86. The nozzle 88 is concentrically congruently and sealably affixed to the tube 86 at the from 40 of the burner 10. The angle $\alpha$, preferably about 4 degrees, is formed by an intersection $\beta$ of the longitudinal axis 30 of the burner 10 and the longitudinal axis 90 of the nozzle 88. Preferably for optimum operation of the novel co-firing aspect of the burner, the intersection $\beta$ is about 8 feet directly in front of the front 40 of the burner 10 or in the center of the hotter and larger flame formed from continuous combustion of the pulverized coal.

The nozzle 88 is selected to deliver a solid conical spray pattern into the pulverized coal flame from a slurry kept in suspension by the use of a recycle pump until ready for use. When the slurry is ready for use, a variable frequency, 10 horsepower/30 gpm progressive cavity positive displacement pump (e.g., manufactured by Moyno™) is used to deliver the slurry at about 140 psi to the orifice of the input 44 of burner 10 connected to a boiler (not shown). The slurry is atomized by the use of the nozzle 88 which functions as an air atomizer, also at 140 psi, capable of atomizing 31 million Btu/hr of coal-water slurry to the burner or about 30% Btu input of the burner. The pulverized coal is delivered to the burner at rate of about 3 tons/hr. However, in actual practice a bank of six burner front-fired burners is used with two pulverizers each capable of producing 8–10 tons of pulverized coal per hour for combustion. The burner 10 preferably has one class-one air-atomized oil gun, the oil lighter 32, for example, that is used for start-up and flame support. The oil lighter 32 is adapted in the present embodiment to burn #2 fuel oil at a rate of 1.25 gpm.

The slurry handling system also includes an automatic flush water system, a slurry mass flow transmitter to accurately provide a signal of slurry fuel flow to the boiler combustion controls, special isolation diaphragms to protect pressure gauges and switches from slurry plugging.

Start-up of the co-firing coal water slurry system is typically as follows: The coal water slurry atomizer or nozzle 88 sprays slurry into the pulverized coal flame after the burner is firing pulverized coal. An atomizing air pressure reducing valve (not shown) may be connected in line in between the slurry supply pump (not shown) and the tube 86 to provide control over the output pressure for the slurry from about 110 psi up to about 140 psi.

While a specific presently operating and preferred embodiment of the invention has been described in detail to illustrate the novel improvement discovered and implemented to improve the utility of the above described burner assembly, the inventor relies upon the doctrine of equivalents and thus one of ordinary skill in this art will understand that this invention may be embodied otherwise using the underlying principle of the invention.

What is claimed is:

1. In a conventional continuously operating steam boiler adapted to generate steam for the production of electricity from a turbine generator comprising a combustion chamber adapted for complete combustion of a fossil fuel, a continuously operating feeding means for continuously supplying the fossil fuel to the said combustion chamber connected to said combustion chamber, a burner having a central longitudinal axis, a rear, and a front, the burner being adapted to sustain continuous combustion of said fossil fuel at its front connected to said chamber, said burner connected to said feeding means, igniting means for igniting said fossil fuel connected to said burner, said igniting means being fueled by an amorphous hydrocarbon adapted for self-sustaining combustion at a temperature sufficient to ignite said fossil fuel wherein steam is continuously produced from water heated from heat produced from continuous combustion of said fossil fuel in a flame in said combustion chamber, the flame having at least two parts with one part being hotter than the other, an improvement comprising a singular means for oblique injection of a continuous non-heated pressurized spray of an aqueous slurry consisting of about 50 weight % coal fines directly into the hotter part of said flame wherein said means extends through said burner from the rear to the front and wherein said burner has a longitudinal axis and said means for oblique injection of a continuous pressurized spray of an aqueous slurry is oriented obliquely to the longitudinal axis of said burner.

2. In a conventional continuously operating steam boiler adapted to generate steam for the production of electricity from a turbine generator comprising a combustion chamber adapted for complete combustion of a fossil fuel, a feeding means for continuously supplying the fossil fuel to the said combustion chamber connected to said combustion chamber, a burner with a rear and a front, the burner having an aperture at its front opening to said combustion chamber, the burner being adapted to sustain continuous combustion of said pulverized solid fuel from said feeding means connected to said chamber, said burner being connected to said feeding means, igniting means for igniting said pulverized solid fuel connected to said burner, said igniting means extending through the burner to its front, said igniting means being fueled by an amorphous hydrocarbon adapted for self-sustaining combustion at a temperature sufficient to ignite said pulverized solid fuel wherein steam is continuously produced from water heated from heat produced from continuous combustion of said pulverized solid fuel in a flame in said combustion chamber, the flame having at least two parts with one part being hotter than the other, an improvement comprising a rigid tube extending from the rear of said burner to said aperture, a spray nozzle attached to said rigid tube at the end of the tube ending at said aperture, said spray nozzle adapted to inject an aqueous slurry containing from about 38 to about 50 weight percent coal fines as a solid conical spray directly into the hotter part of said flame.

3. The improvement of claim 2 wherein said burner has a longitudinal axis and said means for injection of a continuous pressurized spray of an aqueous slurry is a tube oriented obliquely to the longitudinal axis of said burner.

4. The improvement of claim 2 wherein said spray nozzle is adapted to spray said slurry in a solid conical pattern of about 30 degrees.

5. In a conventional continuously operating steam boiler adapted to generate steam for the production of electricity from a turbine generator comprising a combustion chamber, a feeding means for continuously supplying a pulverized solid fuel to the said combustion chamber connected to said combustion chamber, a burner with a rear and a front, the burner having an aperture at its front opening to said combustion chamber, the burner being adapted to sustain continuous combustion of said pulverized solid fuel from said feeding means connected to said chamber, said burner being connected to said feeding means, igniting means for igniting said pulverized solid fuel connected to said burner, said igniting means extending through the burner to its front, said igniting means being fueled by an amorphous hydrocarbon adapted for self-sustaining combustion at a temperature sufficient to ignite said pulverized solid fuel wherein steam is continuously produced from water heated from heat produced from continuous combustion of said pulverized solid fuel in a flame in said combustion chamber, the flame having at least two parts with one part being hotter than the other, an improvement comprising a tube extending from the rear of said burner to said aperture, a spray nozzle attached to said tube at the end of the tube ending at said aperture, said spray nozzle adapted to spray an aqueous coal-water slurry directly into the hotter part of said flame, wherein said burner has a longitudinal axis, said tube is oriented obliquely to the longitudinal axis of said burner, wherein said spray nozzle is adapted to spray said slurry in a solid conical pattern with a vertex and wherein the solid conical pattern has an axis coincident with the longitudinal axis of the rigid tube connected to the spray nozzle and wherein the vertex of the solid conical pattern has an angle of about 30 degrees.

6. The improvement of claim 5 wherein said solid conical pattern has an axis oriented approximately 45 degrees from the longitudinal axis of the burner and wherein the solid conical spray pattern is substantially intersected by said flame.

7. The improvement of claim 1 wherein the burner assembly is substantially horizontally oriented and wherein the tube is obliquely oriented at an angle from the central longitudinal axis of the burner assembly, the tube having a longitudinal axis oriented in a plane oriented other than vertical, the tube being located below the central longitudinal axis of the burner assembly.

8. The improvement of claim 5 further comprising pressure producing means for pressurizing said tube and wherein the flame has a temperature sufficiently elevated to co-fire the fossil fuel and the aqueous slurry consisting of about 50 weight percent coal fines.

* * * * *